US008965246B2

(12) United States Patent
Ao et al.

(10) Patent No.: US 8,965,246 B2
(45) Date of Patent: Feb. 24, 2015

(54) IMAGE FORMING APPARATUS

(75) Inventors: Satoshi Ao, Kanagawa (JP); Masahito Shikata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 203 days.

(21) Appl. No.: 13/601,367

(22) Filed: Aug. 31, 2012

(65) Prior Publication Data

US 2013/0251397 A1 Sep. 26, 2013

(30) Foreign Application Priority Data

Mar. 23, 2012 (JP) ..... 2012-067928

(51) Int. Cl.
*G03G 15/00* (2006.01)
*G03G 21/16* (2006.01)

(52) U.S. Cl.
CPC .... *G03G 21/1633* (2013.01); *G03G 2221/1642* (2013.01)
USPC ..... 399/121; 399/124

(58) Field of Classification Search
CPC ..... G03G 21/1633; G03G 21/168; G03G 2221/1642; G03G 2221/169
USPC ..... 399/110, 121, 124
See application file for complete search history.

(56) References Cited

U.S. PATENT DOCUMENTS

| | | | | |
|---|---|---|---|---|
| 5,940,657 | A * | 8/1999 | Yokomori et al. | 399/119 |
| 8,219,000 | B2 * | 7/2012 | Kuma et al. | 399/121 |
| 8,478,165 | B2 * | 7/2013 | Somemiya et al. | 399/124 |
| 8,682,217 | B2 * | 3/2014 | Murashima | 399/121 |
| 2007/0127947 | A1 * | 6/2007 | Kuma et al. | 399/121 |
| 2008/0240780 | A1 * | 10/2008 | Yamauchi | 399/121 |
| 2010/0278557 | A1 * | 11/2010 | Somemiya et al. | 399/124 |
| 2011/0091238 | A1 * | 4/2011 | Nakazawa | 399/110 |
| 2011/0182614 | A1 * | 7/2011 | Onuma et al. | 399/110 |
| 2012/0163863 | A1 * | 6/2012 | Murashima | 399/121 |
| 2013/0108320 | A1 * | 5/2013 | Ju et al. | 399/121 |
| 2014/0029976 | A1 * | 1/2014 | Nakazawa | 399/107 |

FOREIGN PATENT DOCUMENTS

| | | | |
|---|---|---|---|
| EP | 0794472 | A1 | 5/1997 |
| JP | 08-254862 | A | 10/1996 |
| JP | 09-297442 | A | 11/1997 |

* cited by examiner

*Primary Examiner* — David Gray
*Assistant Examiner* — Carla Therrien
(74) *Attorney, Agent, or Firm* — Sughrue Mion, PLLC

(57) ABSTRACT

An image forming apparatus includes a covering/not-covering member that is supported by an apparatus body so as to be movable between a not-covered position and a covered position; a transporting member that is mountable on and removable from the covering/not-covering member; a positioning member provided at the apparatus body; and an engaging member provided at the covering/not-covering member, the engaging member moving as the transporting member is moved relative to the covering/not-covering member by the positioning member, to engage an engage member and hold the covering/not-covering member at the covered position.

15 Claims, 14 Drawing Sheets

IMAGE FORMING APPARATUS

CROSS-REFERENCE TO RELATED APPLICATIONS

This application is based on and claims priority under 35 USC 119 from Japanese Patent Application No. 2012-067928 filed Mar. 23, 2012.

BACKGROUND

Technical Field

The present invention relates to an image forming apparatus.

SUMMARY

According to an aspect of the invention, there is provided an image forming apparatus including a covering/not-covering member that is supported by an apparatus body so as to be movable between a not-covered position where an opening is not covered by the covering/not-covering member and a covered position where the opening is covered by the covering/not-covering member, the opening being formed in the apparatus body where an image forming operation is performed in an interior of the apparatus body; a transporting member that is mountable on and removable from the covering/not-covering member, the transporting member being movable relative to the covering/not-covering member while the transporting member is mounted on the covering/not-covering member, the transporting member rotating to transport a recording medium on which an image is formed while the transporting member is mounted on the covering/not-covering member and the covering/not-covering member is disposed at the covered position; a positioning member that is provided at the apparatus body, the positioning member coming into contact with the transporting member as the covering/not-covering member disposed at the not-covered position is moved to the covered position, and moving the transporting member, which is disposed at a position that differs from a position where the recording medium is transportable, relative to the covering/not-covering member to position the transporting member to the position where the recording medium is transportable; and an engaging member that is provided at the covering/not-covering member, the engaging member moving as the transporting member is moved relative to the covering/not-covering member by the positioning member, to engage an engage member and hold the covering/not-covering member at the covered position, the engage member being provided at the apparatus body.

BRIEF DESCRIPTION OF THE DRAWINGS

An exemplary embodiment of the present invention will be described in detail based on the following figures, wherein.

DESCRIPTION

An exemplary exposure device and an exemplary image forming apparatus according to an exemplary embodiment of the present invention will be described with reference to FIGS. 1 to 14. Arrows V in the figures each represent a vertical direction. Arrows H in the figures each represent a horizontal direction corresponding to a left-right direction of the apparatus. Arrows D in the figures each represent a horizontal direction towards a far side of the apparatus.

Overall Structure

Figure 14:
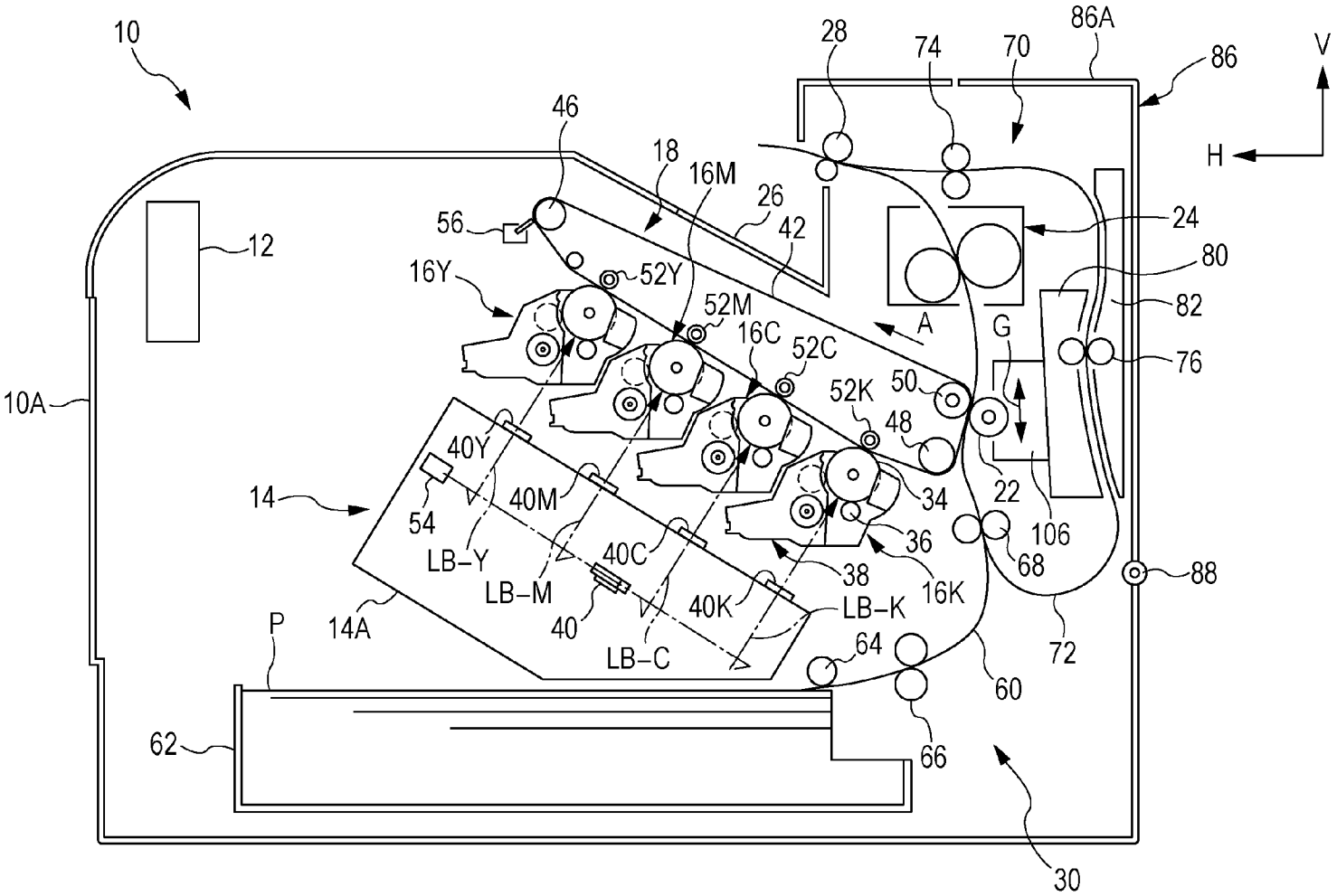
FIG. 14 is a schematic view of the structure of the image forming apparatus according to the exemplary embodiment of the present invention.

As shown in FIG. 14, an image processing section 12 that performs image processing on image data that is input is provided in an interior of an apparatus body 10A of an image forming apparatus 10.

The image processing section 12 processes the input image data into pieces of gradation data of four colors, yellow (Y), magenta (M), cyan (C), and black (K). An exposure device 14 that receives the pieces of gradation data processed by the image processing section 12 and performs image exposure using laser beams LB is provided in the center of the interior of the apparatus body 10A.

Four image forming units 16Y, 16M, 16C, and 16K corresponding to yellow (Y), magenta (M), cyan (C), and black (K) are disposed above the exposure device 14 in the vertical direction so as to be separated from each other at an interval in a direction that is inclined from the horizontal direction, and are mountable to and removable from the apparatus body 10A. The image forming units 16Y, 16M, 16C, and 16K form toner images corresponding to these colors. When the image forming units 16 do not need to be distinguished for describing them using the letters Y, M, C, and K, the letters Y, M, C, and K may be omitted.

A first transfer unit 18 to which the toner images formed by the image forming units 16 for the corresponding colors are first-transferred so as to be superimposed upon each other is provided at upper sides of the image forming units 16 in the vertical direction. Further, a second transfer roller 22 serving as an exemplary transporting member that transfers to a sheet material P the toner images transferred to the first transfer unit 18 so as to be superimposed upon each other is provided beside (the right side in FIG. 14) of the first transfer unit 18. The sheet material P is a recording medium that is transported along a transport path 60 by a supply transport unit 30 (described later).

A fixing device 24 is provided downstream from the second transfer roller 22 in a transport direction of the sheet material P. The fixing device 24 fixes the toner images transferred to the sheet material P by heat and pressure. Discharge rollers 28 are provided downstream from the fixing device 24 in the transport direction of the sheet material P. The discharge rollers 28 discharge the sheet material P to which the toner images are fixed to a discharge section 26 provided at an upper portion of the apparatus body 10A of the image forming apparatus 10.

The supply transport unit 30 that supplies and transports the sheet material P is provided vertically below and beside the exposure device 14.

Image Forming Units

First, each image forming unit 16 will be described.

The image forming units 16 for the corresponding colors all have the same structure. Each image forming unit 16 for the corresponding color includes a circular cylindrical image carrier 34 that rotates, a charging member 36 that charges the outer peripheral surface of the image carrier 34, a developing unit 38 that develops an electrostatic latent image with developer (toner) to form a toner image, and a cleaning blade (not shown) that cleans the outer peripheral surface of the image carrier 34. Each electrostatic latent image is formed on the outer peripheral surface of the corresponding charged image carrier 34 by the image exposure performed by the exposure device 14.

Exposure Device

Next, the exposure device 14 will be described.

Rotating polygonal mirrors 32 are disposed in the interior of a housing 14A of the exposure device 14. The laser beams LB-Y, LB-M, LB-C, and LB-K emitted from semiconductor lasers 54 serving as light sources illuminate the polygonal mirrors 32 through cylindrical lenses (not shown), and are deflected by the polygonal mirrors 32 for scanning in a main scanning direction. Then, the laser beams LB-Y, B-M, LB-C, and LB-K that are deflected by the corresponding polygonal mirrors 32 for scanning scan exposure positions on the corresponding image carriers 34 through an imaging lens and mirrors (not shown) from obliquely below the corresponding image carriers 34 for exposing the image carriers 34 with the light beams LB-Y, LB-M, LB-C, and LB-K.

Accordingly, the exposure device 14 is one that scans and exposes each image carrier 34 from obliquely below each image carrier 34. Therefore, foreign matter, such as toner, from, for example, the developing units 38 of the corresponding image forming units 16 (disposed above the exposure device 16) for the corresponding colors, may drop onto the exposure device 14. Therefore, portions of the housing 14A that face upward at the outer peripheral surface of the housing 14A are provided with transparent glasses 40Y, 40M, 40C, and 40K that transmit the corresponding four laser beams LB-Y, LB-M, LB-C, and LB-K upward towards the image carriers 34 of the image forming units 16 for the corresponding colors.

First Transfer Unit/Second Transfer Roller

Next, the first transfer unit 18 and the second transfer roller 22 will be described.

The first transfer unit 18 is disposed at the upper side of the image forming units 16 for the corresponding colors in the vertical direction. The first transfer unit 18 includes an endless intermediate transfer belt 42; a driving roller 46, upon which the intermediate transfer belt 42 is wound, which is rotationally driven and circulates the intermediate transfer belt 42 in the direction of arrow A; a tension applying roller 48 upon which the intermediate transfer belt 42 is wound and that applies tension to the intermediate transfer belt 42; a driven roller 50 serving as an opposing transporting member that is disposed above the tension applying roller 48 in the vertical direction and that is driven and rotated along with the intermediate transfer belt 42; and first transfer rollers 52 that are disposed opposite the image carriers 34 for the corresponding colors with the intermediate transfer belt 42 being disposed therebetween.

By this, the toner images for the corresponding colors, yellow (Y), magenta (M), cyan (C), and black (K), formed successively on the image carriers 34 of the image forming units 16 for the corresponding colors are transferred onto the intermediate transfer belt 42 so as to be superimposed thereupon by the first transfer rollers 52 for the corresponding colors.

A cleaning blade 56 that contacts and cleans the outer peripheral surface of the intermediate transfer belt 42 is disposed opposite the driving roller 46 with the intermediate transfer belt 42 being disposed therebetween. The second transfer roller 22 that transfers the toner images that have been transferred to the intermediate transfer belt 42 to the sheet material P that is transported is disposed opposite the driven roller 50 with the intermediate transfer belt 42 being disposed therebetween.

By the above operations, the toner images for the corresponding colors, yellow (Y), magenta (M), cyan (C), and black (K), that have been transferred to the intermediate transfer belt 42 so as to be superimposed thereupon are transported by the intermediate transfer belt 42. The toner images that are transported are nipped between the driven roller 50 and the second transfer roller 22, and are second-transferred to the sheet material P that is transported along the transport path 60 by the supply transport unit 30 (described later).

Supply Transport Unit

Next, the supply transport unit 30 that supplies and transports a sheet material P will be described.

The supply transport unit 30 includes a sheet feeding member 62 that is disposed below the exposure device 14 in the vertical direction in the interior of the apparatus body 10A. Sheet materials P are loaded in the sheet feeding member 62.

The supply transport unit 30 further includes a sheet-feed roller 64 that sends out the sheet materials P loaded in the sheet-feeding member 62 into the transport path 60, separating rollers 66 that separate one by one the sheet materials P that are sent out by the sheet-feed roller 64, and positioning rollers 68 that adjust a transport timing of the sheet materials P. These rollers are disposed in this order from an upstream side to a downstream side in the direction of transport of the sheet materials P.

By this structure, the positioning rollers 68 that rotate send out the sheet materials P that are supplied from the sheet-feeding member 62 at a prescribed timing to a position where the intermediate transfer belt 42 and the second transfer roller 22 contact each other (that is, a second transfer position).

Further, the supply transport unit 30 includes a duplex transporting device 70 used for forming toner images on another side of a sheet material P to whose one surface toner images are fixed by the fixing device 44, without discharging the sheet material P to the discharge section 26 by the discharge rollers 28.

The duplex transporting device 70 includes a duplex transport path, transport rollers 74, and transport rollers 76. In the duplex transport path 72, a sheet material P is transported from the discharge rollers 28 towards the positioning rollers 68 so that the front and back of the sheet material P are reversed. The transport rollers 74 and the transport rollers 76 transport the sheet material P along the duplex transport path 72.

The duplex transport path 72 includes a first chute member 80 and a second chute member 82. The first chute member 80 supports one surface of the sheet material P that is transported. The second chute member 82 supports the other surface of the sheet material P that is transported.

An opening 84 (see FIG. 12) is formed in a side (right side in FIG. 12) of the apparatus body 10A. Further, a maintenance door 86, serving as a covering/not-covering member, that is supported by the apparatus body 10A so as to be movable to a not-covered position (see FIG. 12) and a covered position (see FIG. 13) is provided. The not-covered position is where the opening 84 is not covered. The covered position is where the opening 84 is covered.

The maintenance door 86 is supported by the apparatus body 10A by a hinge 88. By rotating the maintenance door 86 around the hinge 88, the maintenance door 86 moves between the not-covered position and the covered position.

The first chute member 80, the second chute member 82, and the second transfer roller 22 are mounted to the maintenance door 86. For example, the structure of the second transfer roller 22 will be described in detail below.

Operation of the Entire Structure

By this structure, images are formed on a sheet material P as follows.

First, pieces of gradation data of the corresponding colors are successively output from the image processing section 12 to the exposure device 14. Then, the laser beams LB-Y, LB-M, LB-C, and LB-K emitted in accordance with the pieces of gradation data from the exposure device 14 scan the outer peripheral surfaces of the image carriers 34 charged by the corresponding charging members 36 to expose the outer peripheral surfaces of the image carriers 34 with the laser beams LB-Y, LB-M, LB-C, and LB-K in a main scanning direction. This causes electrostatic latent images to be formed on the outer peripheral surfaces of the image carriers 34. The electrostatic latent images formed on the image carriers 34 are developed by the developing units 38 for the corresponding colors, to make visible the toner images for the corresponding colors, yellow (Y), magenta (M), cyan (C), and black (K).

Further, the toner images for the corresponding colors, yellow (Y), magenta (M), cyan (C), and black (K), formed on the image carriers 34, are transferred by the first transfer rollers 52 of the first transfer unit 18 to the circulating intermediate transfer belt 42 so as to be superimposed thereupon.

The toner images for the corresponding colors that are transferred to the circulating intermediate transfer belt 42 so as to be superimposed thereupon are second-transferred by the second transfer roller 22 to the sheet material P that is transported along the transport path 60 from the sheet feeding member 62 by the sheet-feed roller 64, the separating rollers 66, and the positioning rollers 68.

Further, the sheet material P to which the toner images are transferred is transported to the fixing device 44. Then, the toner images are fixed to the sheet material P by the fixing device 44. The sheet material P to which the toner images are fixed is discharged to the discharge section 26 by the discharge rollers 28.

When images are to be formed on both surfaces of the sheet material P, the sheet material P to whose one surface (front surface) the toner images have been fixed by the fixing device 44 is not discharged as it is to the discharge section 26 by the discharge rollers 28. By reversely rotating the discharge rollers 28, the direction of transport of the sheet material P is switched. The sheet material P is transported along the duplex transport path 72 by the transport rollers 74 and the transport rollers 76.

The sheet material P that is transported along the duplex transport path 72 has its front and back surfaces reversed and is transported again towards the positioning rollers 68. After the toner images have been transferred and fixed to the other surface (back surface) of the sheet material P, this time, the sheet material P is discharged to the discharge section 26 by the discharge rollers 28.

Structure of Principal Portion

Next, for example, the structure of the second transfer roller 22 mounted on the maintenance door 86 will be described.

Second Transfer Roller

Figure 7:
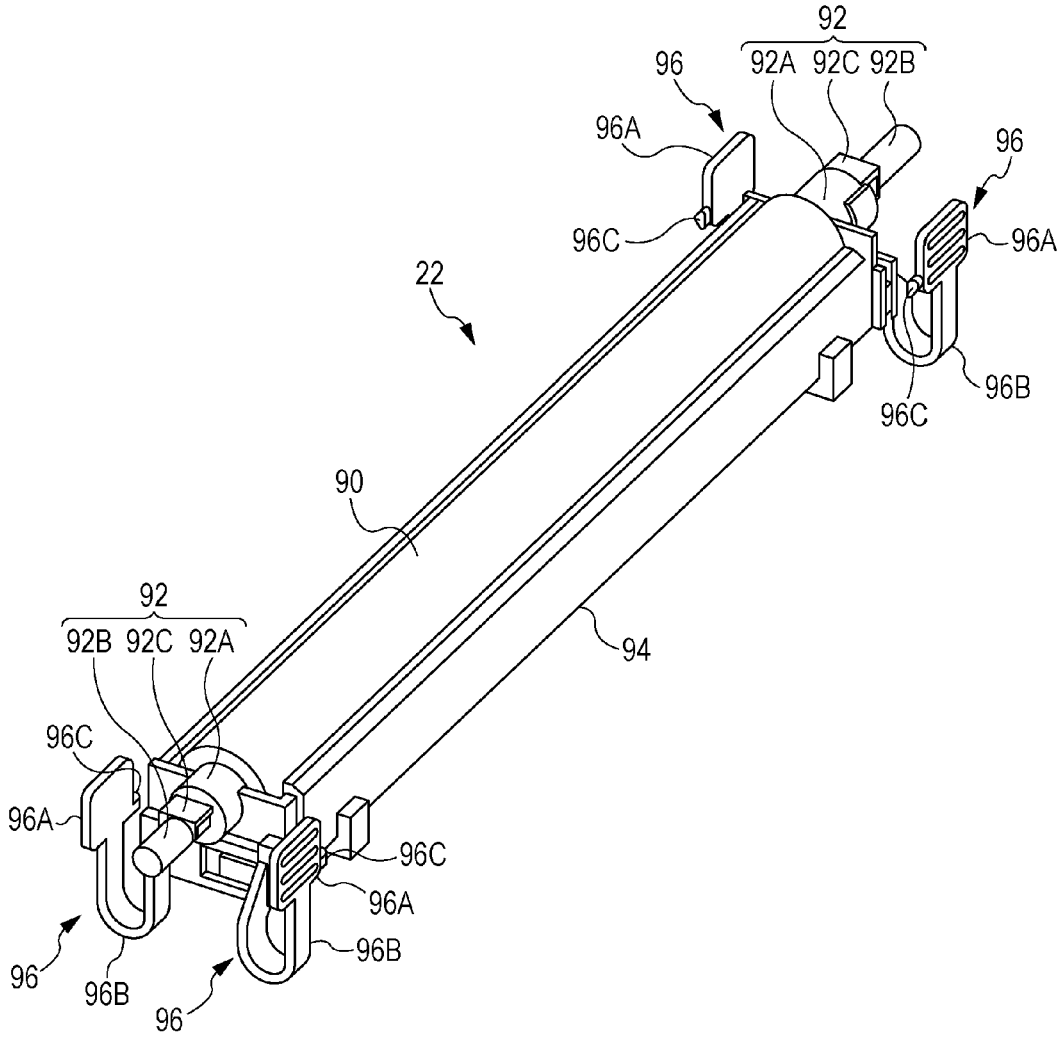
FIG. 7 is a perspective view of a second transfer roller used in the image forming apparatus according to the exemplary embodiment of the present invention.

As shown in FIG. 7, the second transfer roller 22 includes a roller body 90, a pair of bearing members 92, a supporting member 94, and mounting members 96. The pair of bearing members 92 receive a rotating shaft (not shown). The supporting member 94 supports the bearing members 92. The mounting members 96 are provided at corresponding ends of the supporting member 94, and are mounted on the maintenance door 86.

Each bearing member 92 includes a general portion 92A that is supported by the supporting member 94, a small diameter portion 92B having a smaller diameter than the general portion 92A and extending outward, and an intermediate portion 92C provided between the general portion 92A and the small diameter portion 92B.

The supporting member 94 extends in a rotation axial direction of the second transfer roller 22 (may hereunder simply be referred to as "a roller axial direction", which is the same as a direction of a far side of the apparatus in the exemplary embodiment), and is provided with the aforementioned mounting members 96 at the corresponding ends thereof in the longitudinal direction.

Two mounting members 96 are provided at one side in the roller axial direction. Two mounting members 96 are disposed on both sides of the corresponding bearing member 92 as seen from the roller axial direction. Each mounting member 96 includes gripping portions 96A that are gripped by an operator, U-shaped flexible portions 96B that are flexed when the operator grips the gripping portions 96A, and protruding portions 96C that protrude inwardly in the roller axial direction from the gripping portions 96A. An end portion of each flexible portion 96B is secured to the supporting member 94.

Figure 8:
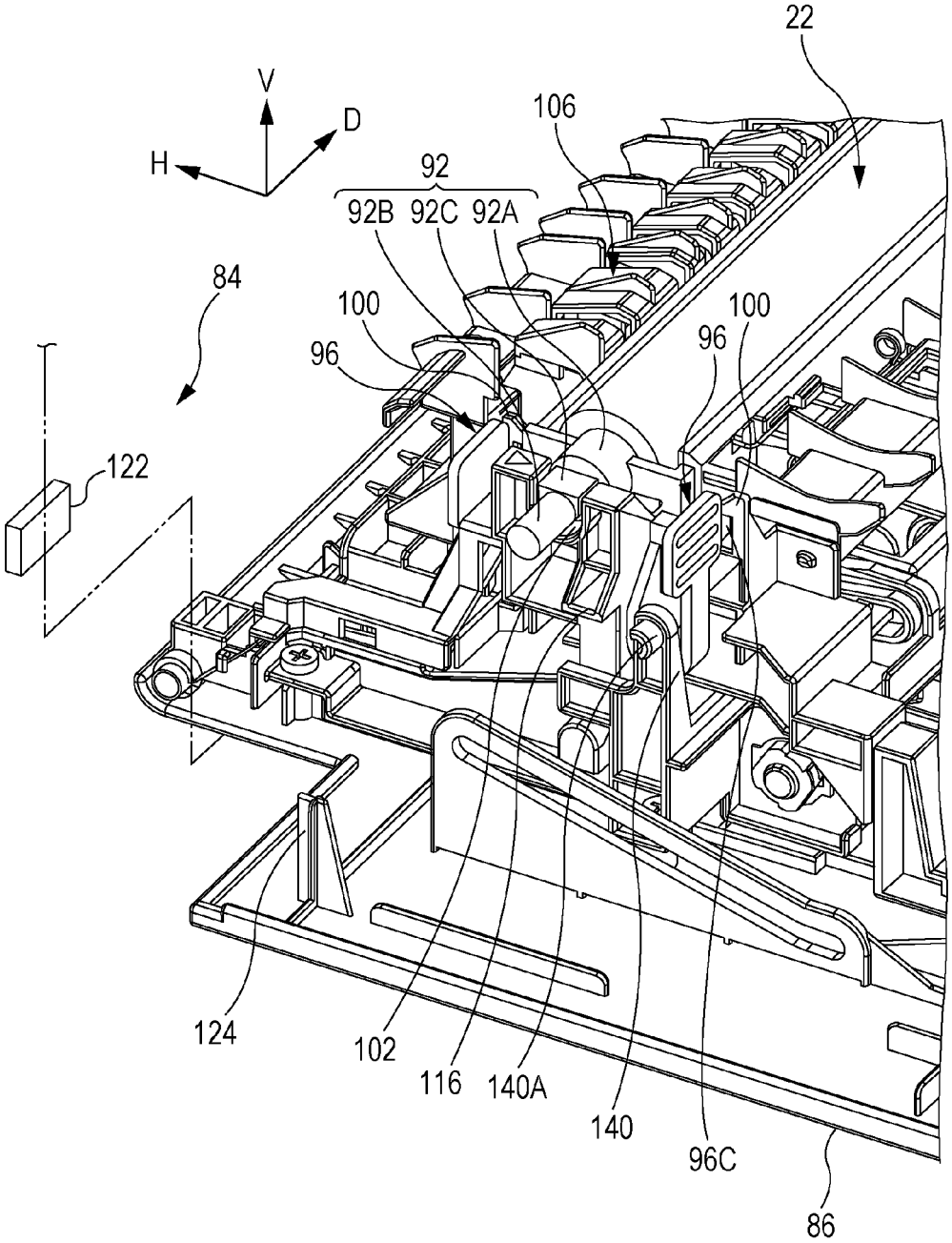
FIG. 8 is a perspective view of an inner side of a maintenance door used in the image forming apparatus according to the exemplary embodiment of the present invention.
Figure 10:
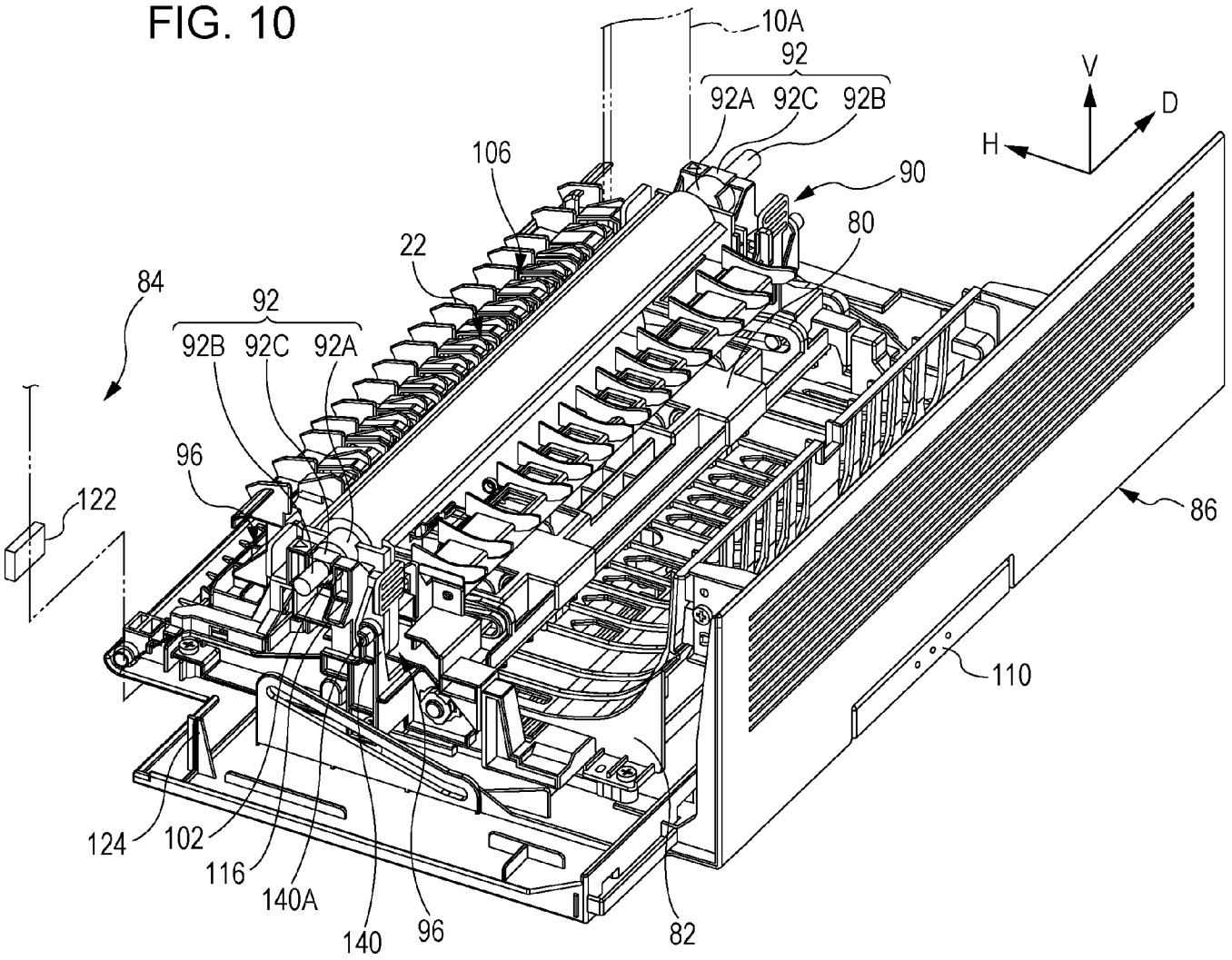
FIG. 10 is a perspective view of the inner side of the maintenance door used in the image forming apparatus according to the exemplary embodiment of the present invention.

As shown in FIGS. 8 and 10, the maintenance door 86 is provided with a moving member 106 where lugs 100 that engage the protruding portions 96C of the corresponding mounting member 96 and a supporting portion 102 that supports the intermediate portion 92C of the corresponding bearing member 92 are formed.

In this structure, when an operator grips the pair of gripping portions 96A of the second transfer roller 22 mounted on the maintenance door 86, the flexing portions 96B flex, so that the gripping portions 96A and the protruding portions 96C come closer to the bearing member 92. This disengages the protruding portions 96C and the lugs 100. In this state, by lifting the second transfer roller 22, the second transfer roller 22 is removable from the moving member 106.

Moving Member

Next, the moving member 106 where the lugs 100 and the supporting portions 102 are formed will be described.

Figure 9:
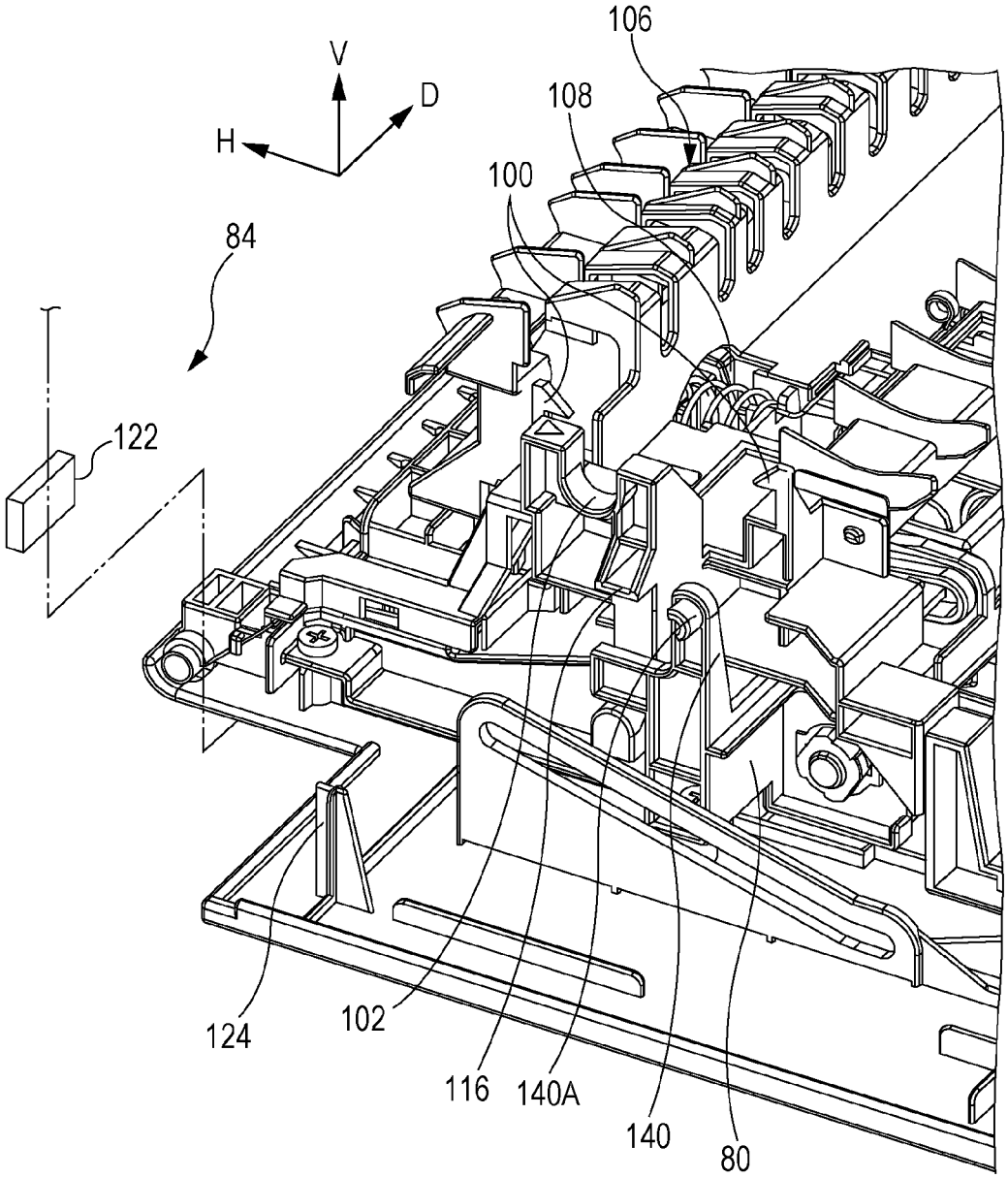
FIG. 9 is a perspective view of the inner side of the maintenance door used in the image forming apparatus according to the exemplary embodiment of the present invention.
Figure 11:
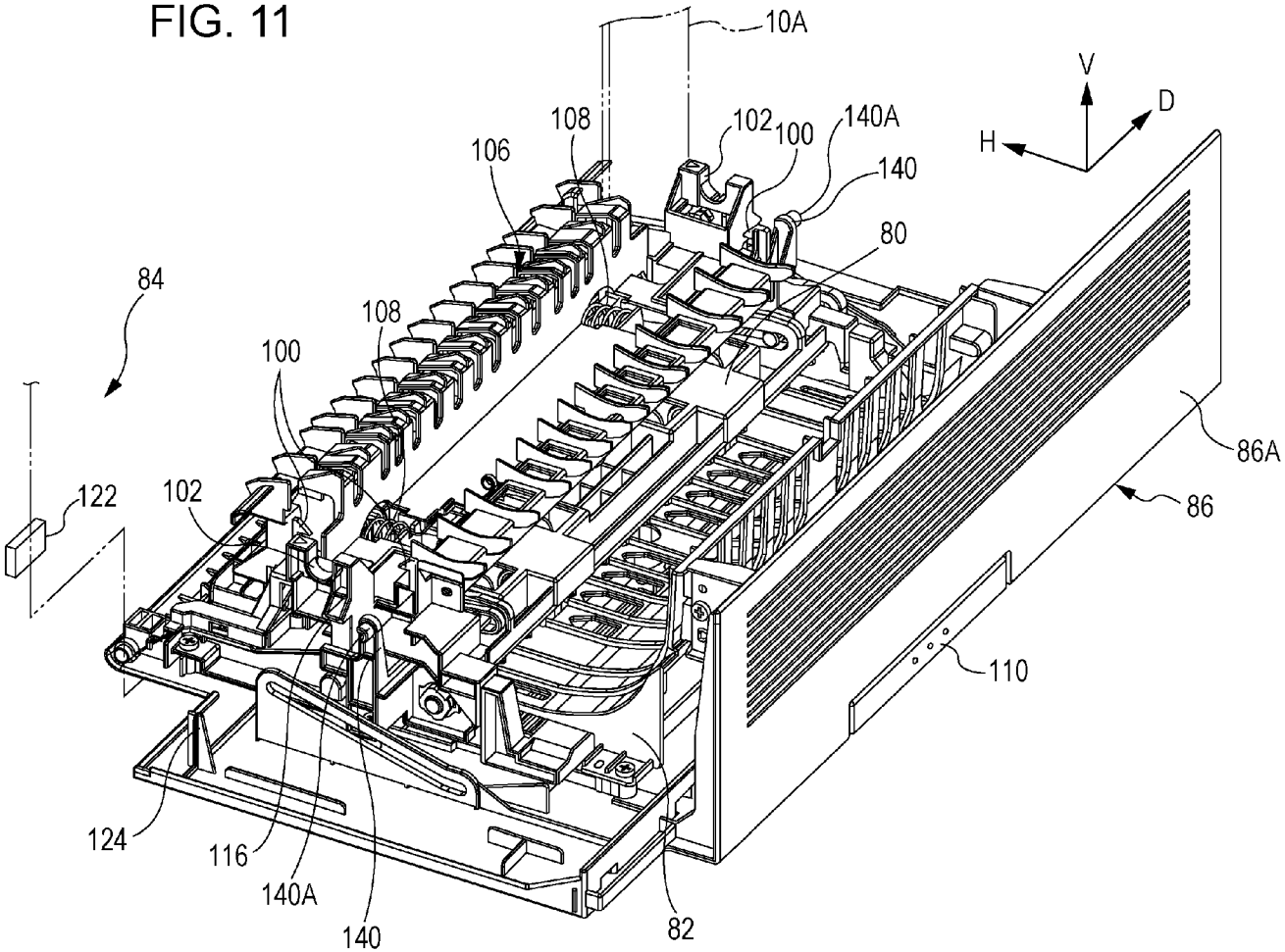
FIG. 11 is a perspective view of the inner side of the maintenance door used in the image forming apparatus according to the exemplary embodiment of the present invention.

As shown in FIG. 14, the moving member 106 is disposed opposite the second chute member 82 with the first chute member 80 being disposed therebetween. Further, as shown in FIGS. 9 and 11, the lugs 100 and the supporting portions 102 are integrated to the moving member 106.

The moving member 106 is movably mounted on the first chute member 80, and is movable relative to the maintenance door 86. This also makes it possible for the second transfer roller 22 mounted on the moving member 106 to move relative to the maintenance door 86.

More specifically, as shown in FIG. 14, while the maintenance door 86 is disposed at the covered position, the moving member 106 is movable relative to the maintenance door 86 in a direction in which an upper side is inclined towards an inner portion of the apparatus (in the directions of double-headed arrow G in FIG. 14) with respect to the vertical direction as viewed from the roller axial direction. This also makes it possible for the second transfer roller 22 to be movable relative to the maintenance door 86 in the direction of double-headed arrow G.

At a basic position that is reached when the second transfer roller 22 is moved towards one side (that is, towards a top plate 86A of the maintenance door 86), a stopper member (not shown) and the moving member 106 contact each other to regulate the movement of the second transfer roller 22 towards the one side. As shown in FIG. 11, two urging springs 108 that urge the moving member 106 towards the top plate 86A so that the second transfer roller 22 is disposed at the basic position are provided at the maintenance door 86.

Figure 12:
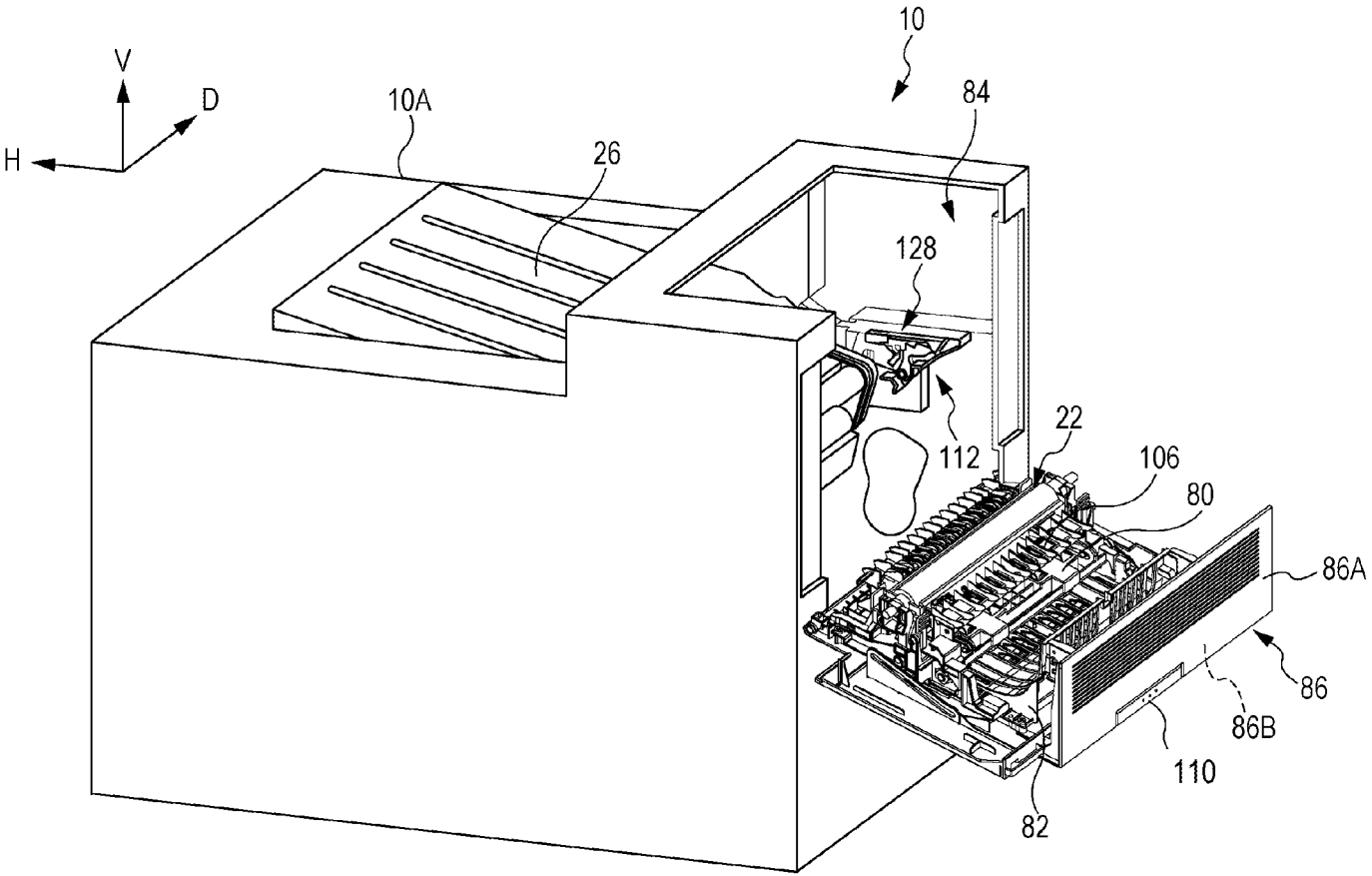
FIG. 12 is a perspective view of the image forming apparatus according to the exemplary embodiment of the present invention.
Figure 13:
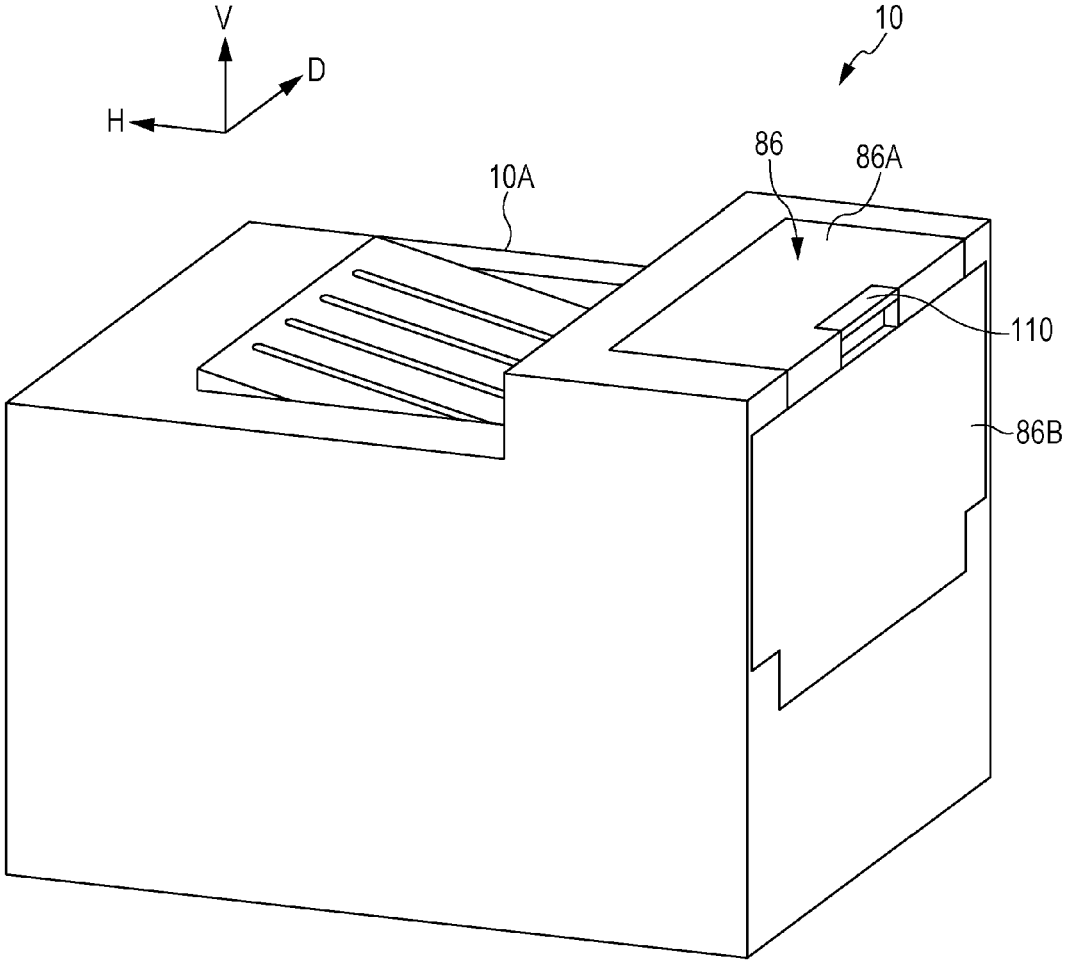
FIG. 13 is a perspective view of the image forming apparatus according to the exemplary embodiment of the present invention.

As shown in FIGS. 12 and 13, a pressing portion 110 that moves the movable member 106 away from the top plate 86A towards the other side when the pressing portion 110 is pressed from an outer portion is provided at a corner formed by the top plate 86A and a side plate 86B of the maintenance door 86.

In this structure, by pressing the pressing portion 110 towards the inner portion of the apparatus, the moving member 106 moves against the urging force of the urging springs 108, so that the second transfer roller 22 at the basic position moves towards the other side away from the top plate 86A.

Positioning Member

Next, positioning members 112 that come into contact with the second transfer roller 22 as the maintenance door 86 disposed at the not-covered position is moved towards the covered position, and that position the second transfer roller 22 with respect to the apparatus body 10A will be described. The positioning members 112 are provided at a near side and a far side of the apparatus.

Figure 6:
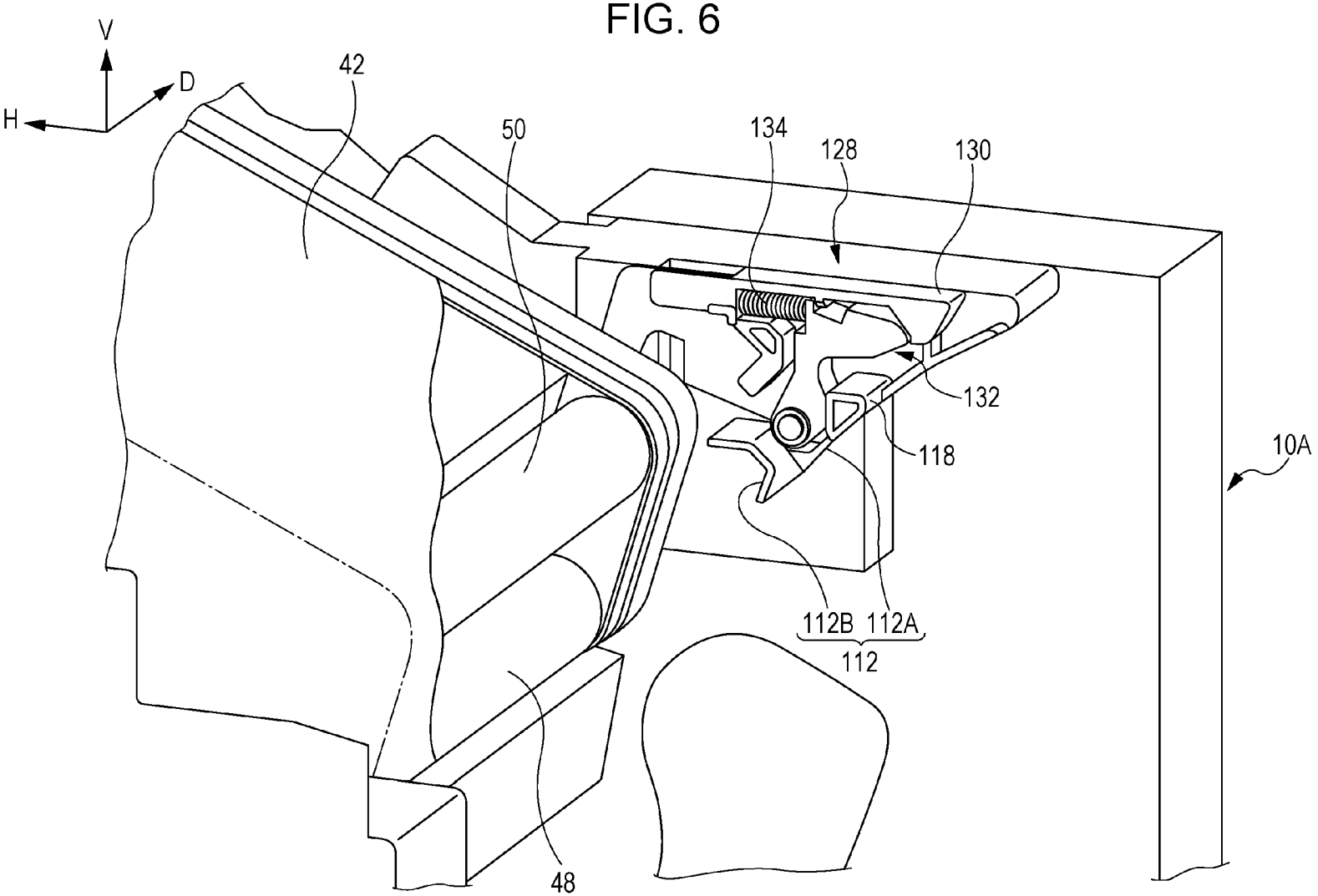
FIG. 6 is a perspective view of the operation device used in the image forming apparatus according to the exemplary embodiment of the present invention.

As shown in FIGS. 2 and 6, each positioning member 112 includes a slope portion 112A that presses the small diameter portion 92B (see FIG. 7) of the bearing member 92 as the maintenance door 86 is moved towards the covered position, and that moves the second transfer roller 22 towards the other side away from the top plate 86A. Each positioning member 112 also includes a positioning portion 112B that positions the second transfer roller 22 at an operating position (where images are formable) when the maintenance door 86 is pushed towards the covered position, and each positioning portion 112B contacts the corresponding small diameter portion 92B that has separated from an end portion of the slope portion 112A and has moved towards the top plate 86A by the urging force of each urging spring 108.

Figure 2A:
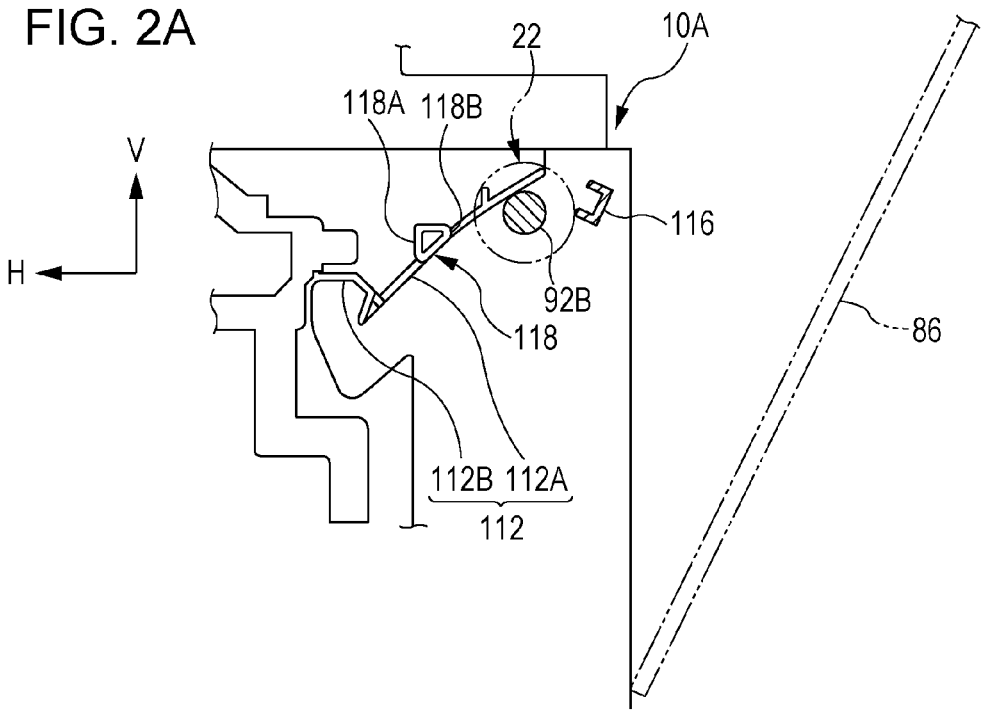
FIGS. 2A and 2B are each a side view of, for example, the positioning member, a small-diameter portion, and the engaging portion used in the image forming apparatus according to the exemplary embodiment of the present invention.
Figure 2B:
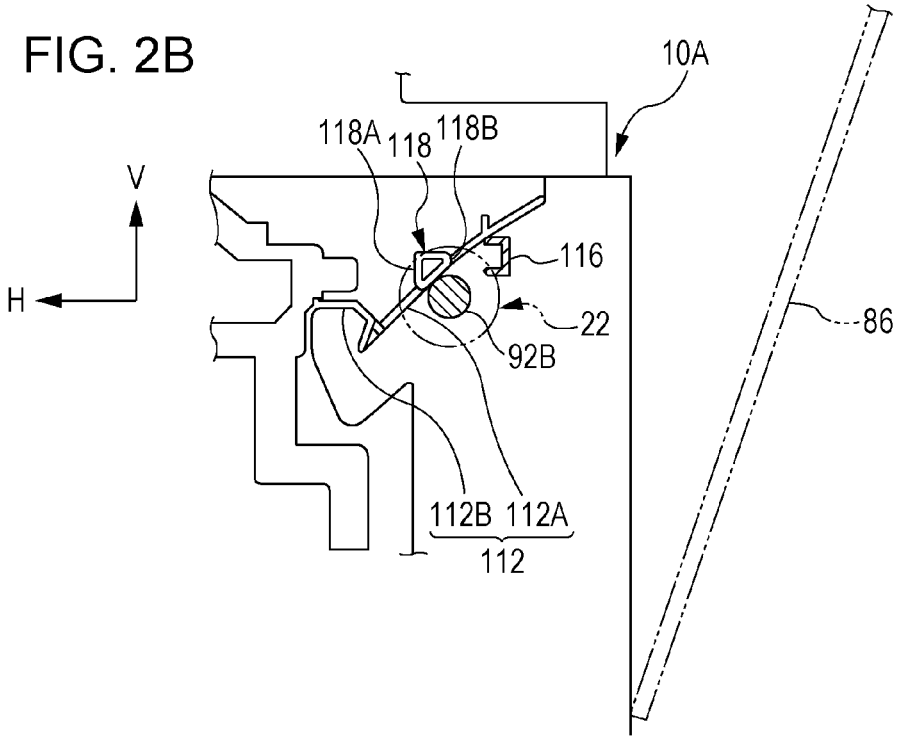
Figure 3A:
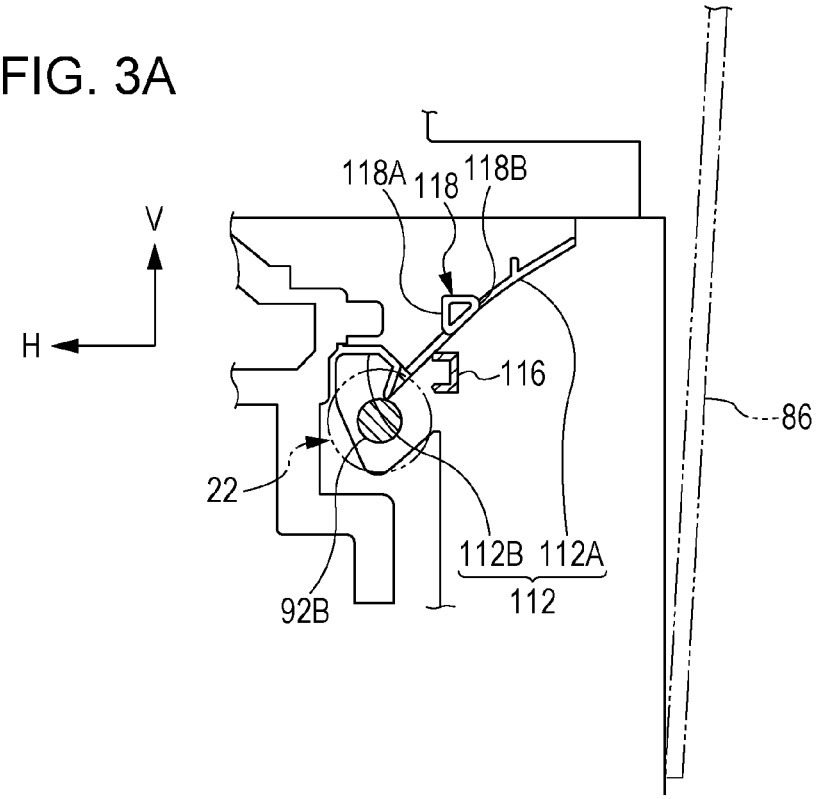
FIGS. 3A and 3B are each a side view of, for example, the positioning member, the small-diameter portion, and the engaging portion used in the image forming apparatus according to the exemplary embodiment of the present invention.
Figure 3B:
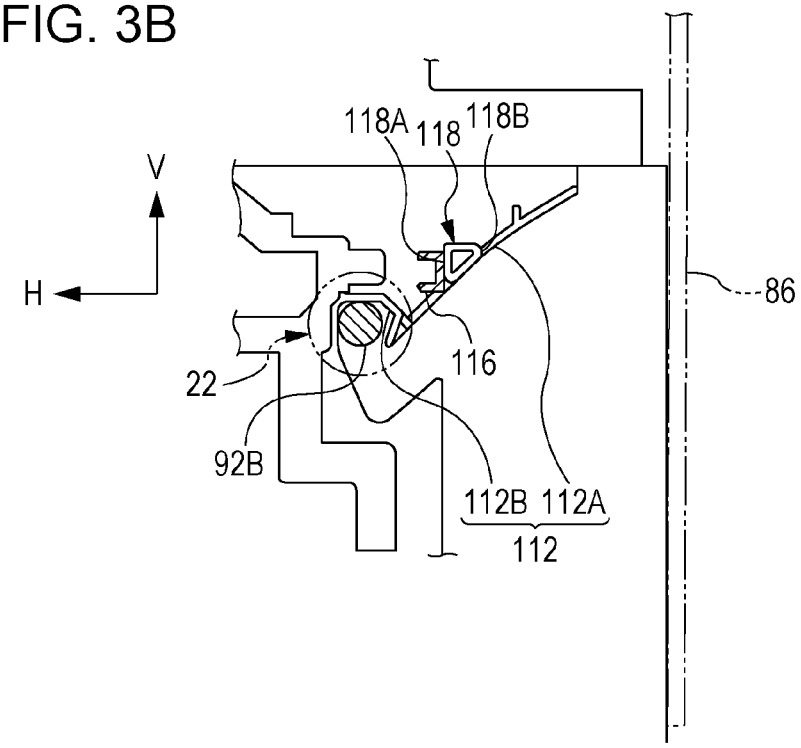

In this structure, as shown in FIGS. 2A and 2B and 3A, as the maintenance door 86 moves towards the covered position, each small diameter portion 92B is pushed against its corresponding slope portion 112A, and the second transfer roller 22 moves towards the other side away from the top plate 86A. Further, as shown in FIG. 3B, when the maintenance door 86 is pushed towards the covered position, each positioning portion 112B contacts its corresponding small diameter portion 92B that has separated from the end portion of the slope portion 112A and that has moved towards the top plate 86A by the urging force of each urging spring 108, so that the second transfer roller 22 is positioned at the operating position. In this state, as described later, the maintenance door 86 is disposed at the covered position.

Engaging Portion/Engage Portion

Next, engaging portions 116, serving as exemplary engaging members, and engage portions 118, serving as exemplary engage members, will be described. The engaging portions 116 and the engage portions 118 are used for holding at the covered position the maintenance door 86 that has moved to the covered position when the maintenance door 86 disposed at the not-covered position has moved to the covered position.

As shown in FIGS. 8 and 10, in the vicinity of the supporting portions 102 in the moving member 106, the engaging portions 116 that protrude outwards in the roller axial direction are integrated to the moving member 106.

In contrast, as shown in FIGS. 2A and 6, the engage portions 118 is formed at the apparatus body 10A. Each engage portion 118 protrudes inward in the roller axial direction from a portion of its corresponding slope portion 112A and engages its corresponding engaging portion 116 while the maintenance door 86 is disposed at the covered position (see FIG. 3B).

In this structure, as shown in FIGS. 2A, 2B, and 3A, as the maintenance door 86 moves towards the covered position, each small diameter portion 92B is pressed against its corresponding slope portion 112A, so that each engaging portion 116, formed at the moving member 106, moves towards the other side away from the top plate 86A. This causes each engaging portion 116 to pass below its corresponding engage portion 118 and to move towards the inner side of the apparatus (that is, the left side in the figures). Further, as shown in FIG. 3B, when the maintenance door 86 is pushed towards the covered position, as each small diameter portion 92B separates from the end portion of its corresponding slope portion 112A and moves towards the top plate 86A by the urging force of each urging spring 108, each engaging portion 116 also moves towards the top plate 86A. This causes each engaging portion 116 to contact a back surface 118A of its corresponding engage portion 118 (that is, the surface that faces the inner portion of the apparatus), and to engage its corresponding engage portion 118 from the inner side (that is, the left side in the figures) of the apparatus. In this state, when each engaging portion 116 and its corresponding engage portion 118 engage each other, the maintenance door 86 is held in the covered position.

Figure 1:
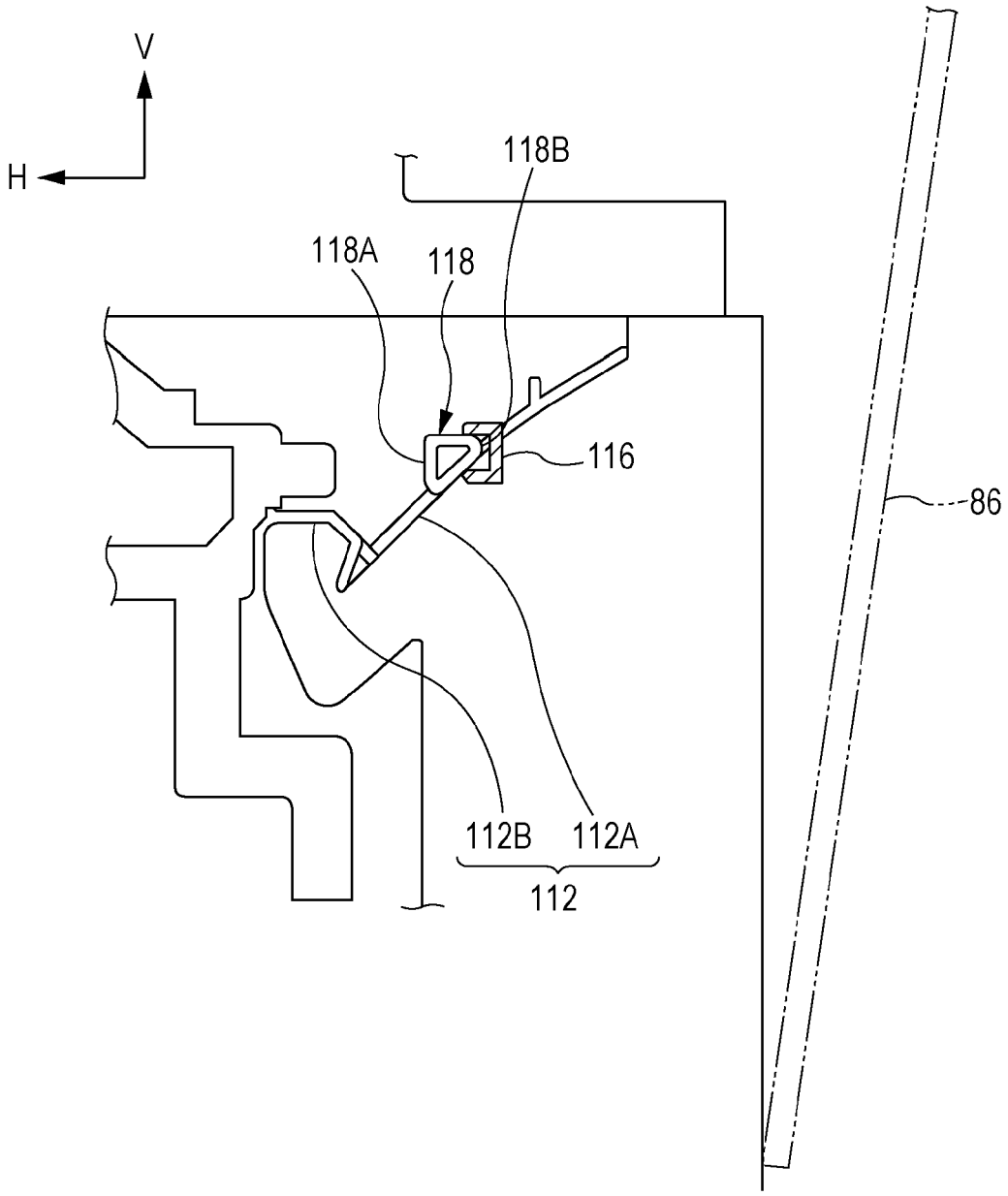
FIG. 1 is a side view of, for example, a positioning member and an engaging portion used in an image forming apparatus according to an exemplary embodiment of the present invention.

In contrast, as shown in FIG. 1, when the moving member 106 does not move relative to the maintenance door 86, as the maintenance door 86 moves towards the covered position, each engaging portion 116 engages its corresponding protruding portion 118B from the outer side (that is, the right side) of the apparatus. Each protruding portion 118B serves as an inhibiting member provided at its corresponding engage portion 118. This inhibits the movement of the maintenance door 86 towards the covered position.

Interlock Switch

Next, an interlock switch 122 will be described. The interlock switch 122 serves as an allowing/prohibiting member that allows the image forming apparatus 10 to perform an image forming operation as a result of moving the maintenance door 86 disposed at the not-covered position to the covered position.

Figure 5A:
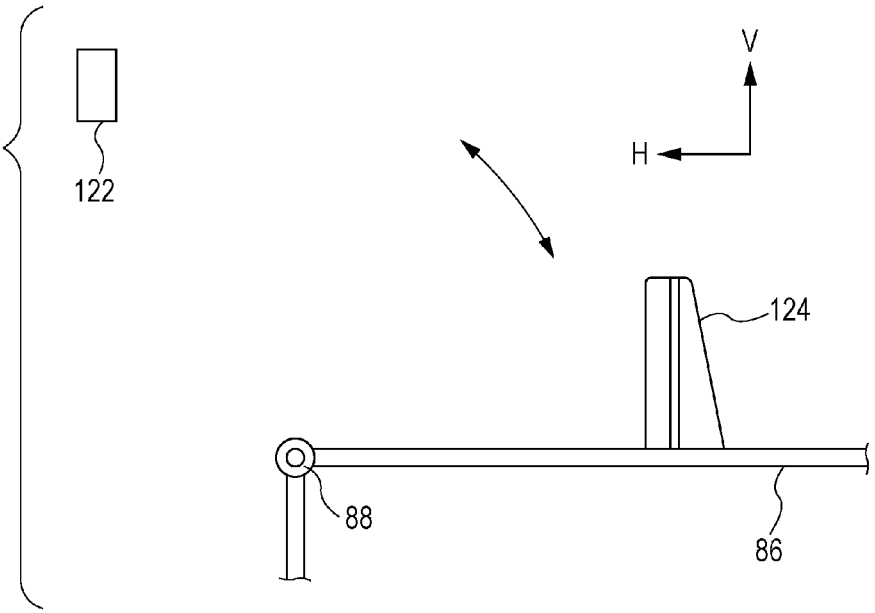
FIGS. 5A and 5B are each a side view of, for example, an interlock switch used in the image forming apparatus according to the exemplary embodiment of the present invention.
Figure 5B:
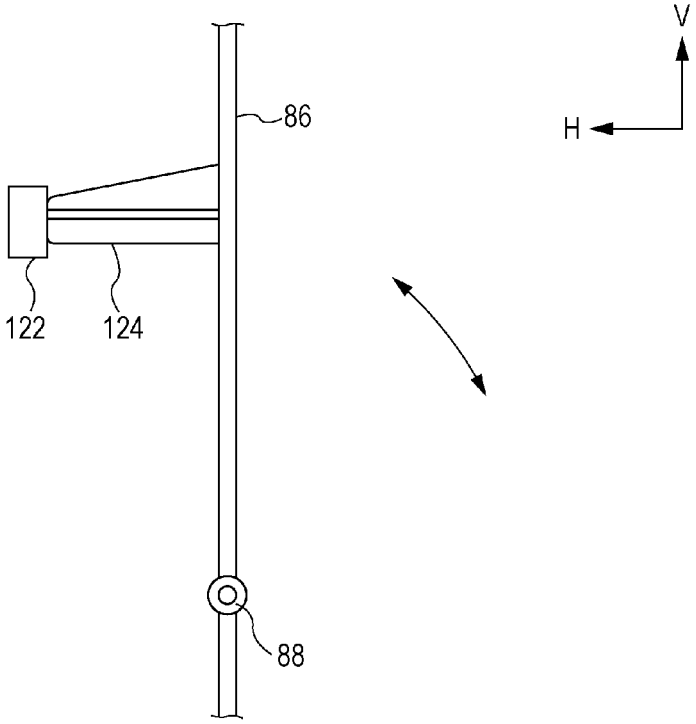

As shown in FIGS. 5A, 5B, and 10, the interlock switch 122 is provided in the interior of the apparatus body 10A. The interlock switch 122 allows the image forming apparatus 10 to perform an image forming operation when the interlock switch 122 is switched on and prohibits the image forming apparatus 10 from performing an image forming operation when the interlock switch 122 is switched off.

A pressing protrusion 124 is formed on the maintenance door 86. By moving the maintenance door 86 disposed at the not-covered position to the covered position, an end of the pressing protrusion 124 contacts the interlock switch 122 in the off state and turns on the interlock switch 122.

Operation Devices

Next, operation devices 128 will be described. Each operation device 128 serves as another exemplary positioning member that, as the maintenance door 86 disposed at the not-covered position is moved towards the covered position, moves the driven roller 50 to an opposing position where the driven roller 50 opposes the second transfer roller 22 with the intermediate transfer belt 42 being disposed therebetween.

As shown in FIG. 6, the operation devices 128 are disposed above the positioning member 112 in the vertical direction, and are disposed at an apparatus far side and an apparatus near side of the apparatus body 10A (in FIG. 6, only one of the operation devices 128 is shown).

Figure 4A:
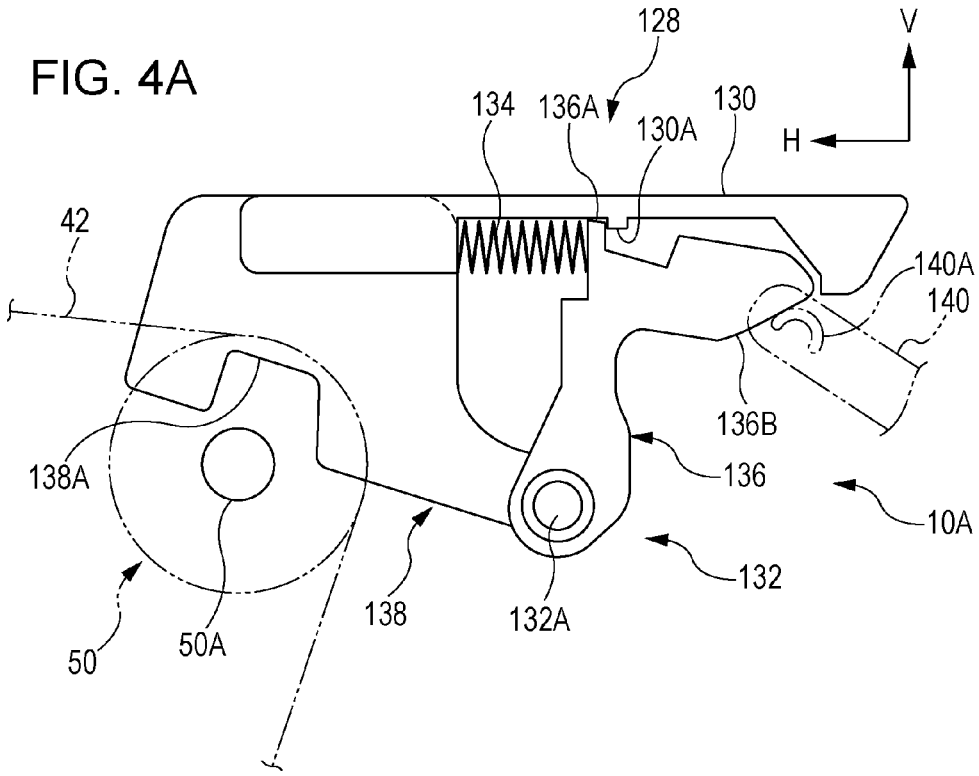
FIGS. 4A and 4B are each a side view of an operation device used in the image forming apparatus according to the exemplary embodiment of the present invention.
Figure 4B:
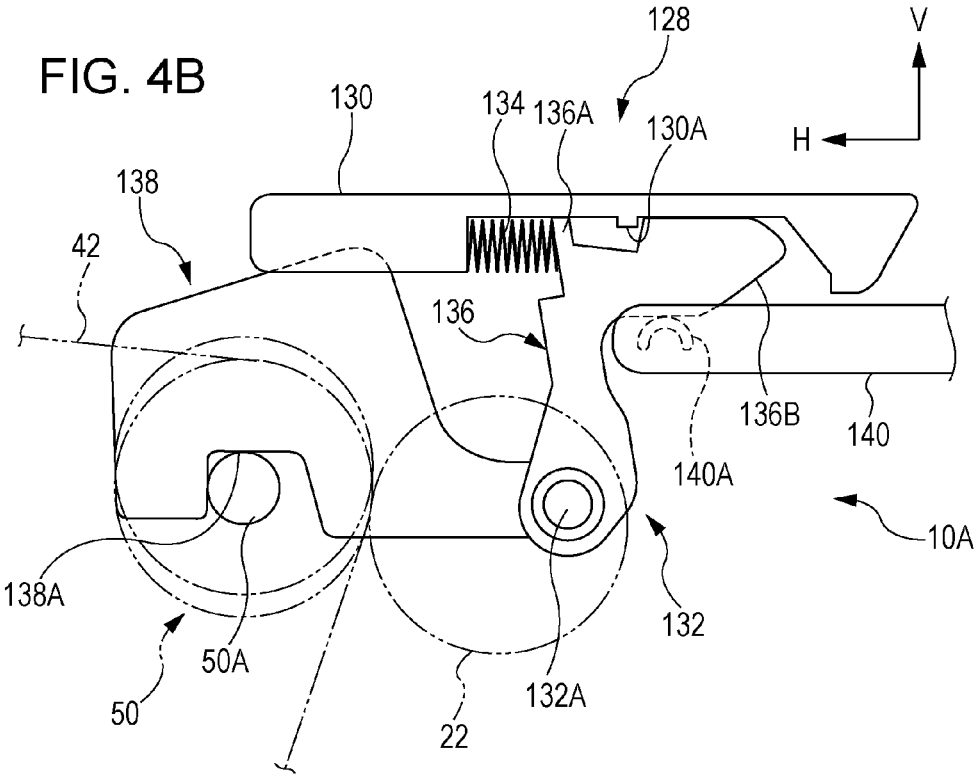

As shown in FIGS. 4A and 4B, each operation device 128 includes a base member 130 and a rotation regulating member 132. Each base member 130 is secured to a frame member (not shown) of the apparatus body 10A. Each rotation regulating member 132 is capable of contacting its corresponding base member 130, and is capable of rotating around a shaft portion 132A secured to the frame member (not shown). Each operation device 128 further includes an urging spring 134 disposed between the rotation regulating member 132 and the base member 130 and urges the rotation regulating member 132 towards a deregulation position (described later).

Each rotation regulating member 132 includes a first member 136 that contacts the base member 130, and a second member 138 that is capable of contacting a rotating shaft 50A of the driven roller 50. Each first member 136 and its corresponding second member 138 are secured in the vicinity of the shaft portion 132A, and rotates together around the shaft portion 132A.

Each first member 136 includes a contact portion 136A. Each contact portion 136A contacts its corresponding protruding portion 130A of the base member 130 by the urging force of the urging spring 134 while the rotation regulating member 132 is disposed at the deregulation position (see FIG. 4A). Further, each first member 136 includes a press portion 136B that is formed at the first chute 80 so as to protrude into the interior of the apparatus body 10A. Each press portion 136B is pressed by its corresponding pressing portion 140 (see FIG. 11) as the maintenance door 86 moves to the covered position. By this, when the press portion 136B is pressed by its corresponding pressing portion 140, the rotation regulating member 132 that is disposed at the deregulation position is moved to a regulation position (see FIG. 4B).

Each second member 138 includes a recessed regulating portion 138A that moves and regulates the rotating shaft 50A by contacting the rotating shaft 50A so that the driven roller 50 is disposed at the aforementioned opposing position while each rotation regulating member 132 is pressed by it corresponding pressing portion 140 and disposed at the regulation position (see FIG. 4B). While the rotating shaft 50A is not regulated by the regulating portions 138A, the driven roller 50 is at a standby position (see FIG. 4A), differing from the opposing position, by the urging force of an urging spring (not shown). While the driven roller 50 is disposed at the standby position, the first transfer unit 18 is separable from the apparatus body 10A (see FIG. 14).

In this structure, while the maintenance door 86 is disposed at the not-covered position, as shown in FIG. 4A, each rotation regulating member 132 is disposed at the deregulation position, where the driven roller 50 is not regulated, by the urging force of the urging spring 134. In this state, the driven roller 50 is disposed at the standby position.

In contrast, when the maintenance door 86 disposed at the not-covered position is moved towards the covered position, as shown in FIG. 4B, a semicircular contact portion 140A of each pressing portion 140 presses its corresponding press portion 136B, and rotates its corresponding rotation regulating member 132. When each rotation regulating member 132 is moved to the regulation position, each regulating portion 138A moves the shaft member 50A, so that the driven roller 50 that has been disposed at the standby position moves to the opposing position. While the driven roller 50 is disposed at the opposing position, the first transfer unit 18 is incapable of separating from the apparatus body 10A (see FIG. 14).

Operation of Structure of Principal Portion

Next, the operation of a structure of a principal portion will be described.

As shown in FIG. 13, while the maintenance door 86 is disposed at the covered position, the second transfer roller 22 moves to the operation position, each rotation regulating member 132 is disposed at the regulation position, and the driven roller 50 is disposed at the opposing position (see FIG. 4B).

As shown in FIG. 3B, each engaging portion 116 engages its corresponding engage portion 118 from the inner side (that is, the left side in FIG. 3B) of the apparatus. This causes the maintenance door 86 to be held at the covered position. In this state, the first transfer unit 18 is incapable of being separated from the apparatus body 10A (see FIG. 14).

Further, as shown in FIG. 5B, an end portion of the pressing protrusion 124 contacts the interlock switch 122, to switch on the interlock switch 122. This allows the image forming apparatus 10 to perform an image forming operation. A body gear (not shown) and a door gear (not shown) engage each other, so that rotational force is transmitted from the body to the transport rollers 76 (see FIG. 14) of the duplex transporting device 70.

For example, when the second transfer roller 22 is to be replaced, as shown in FIG. 13, the pressing portion 110 of the maintenance door 86 disposed at the covered position is pressed downward in the vertical direction. This causes the moving member 106 to move towards the other side away from the top plate 86A.

By moving the moving member 106 towards the other side, as shown in FIG. 3A, each small diameter portion 92B is pushed out from its corresponding positioning portion 112B. Then, as shown in FIGS. 2A and 2B, each small diameter portion 92B is moved upward in the vertical direction along its corresponding slope portion 112A by the urging force of its corresponding urging spring 108. This causes the maintenance door 86 to move to the not-covered position (FIGS. 10 and 12).

Each engaging portion 116 passes below its corresponding engage portion 118 and moves from the inner side of the apparatus to the outer side of the apparatus with respect to its corresponding engage portion 118, so that each engaging portion 116 and its corresponding engage portion 118 are disengaged. This causes the maintenance door 86 to move to the not-covered position.

By moving the maintenance door 86 to the not-covered position, the second transfer roller 22 moves to the standby position, each rotation regulating member 132 moves to the deregulation position (see FIG. 4A), and the driven roller 50 moves to the standby position. In this state, the first transfer unit 18 is capable of separating from the apparatus body 10A (see FIG. 14).

Further, as shown in FIG. 5A, the end portion of the pressing protrusion 124 separates from the interlock switch 122, so that the interlock switch 122 is switched off, thereby prohibiting the image forming apparatus 10 from performing an image forming operation (that is, interlocking is performed). Gears (not shown) are separated from each other, so that rotational force is not transmitted to the transport rollers 76 of the duplex transporting device 70.

As shown in FIGS. 7, 8, and 10, in the case in which the second transfer roller 22 is separated from the moving member 106, when the pair of gripping portions 96A are gripped, the flexing portions 96B are flexed. When the flexing portions 96B are flexed, the gripping portions 96A and the protruding portions 96C are displaced so as to approach the bearing members 92. This causes the protruding portions 96C and the lugs 100 to disengage from each other, and the second transfer roller 22 to be lifted, so that the second transfer roller 22 is separated from the moving member 106.

When the second transfer roller 22 is to be mounted on the moving member 106, the second transfer roller 22 is mounted on the moving member 106 by performing steps which are the reverse of the steps that are performed to separate the second transfer roller 22.

When an attempt is made to mount the second transfer roller 22 on the moving member 106 and move the maintenance door 86 towards the covered position, as shown in FIGS. 2A, 2B, and 3A, each small diameter portion 92B presses its corresponding slope portion 112A. This causes the second transfer roller 22 to move to the other side away from the top plate 86A. As shown in FIG. 3B, when the maintenance door 86 is further moved towards the covered position, each positioning portion 112B contacts its corresponding small diameter portion 92B that has separated from an end portion of its corresponding slope portion 112A and has moved towards the top plate 86A by the urging force of each urging spring 108. This causes the second transfer roller 22 to be moved to and positioned at the operating position.

Further, each engaging portion 116 that moves along a movement path of its corresponding small diameter portion 92B passes below its corresponding engage portion 118, and contacts the back surface 118A of its corresponding engage portion 118. This causes each engaging portion 116 and its corresponding engage portion 118 to engage each other, so that the maintenance door 86 is held at the covered position.

As shown in FIGS. 4A and 4B, as the maintenance door 86 moves towards the covered position, the contact portion 140A of each pressing portion 140 presses its corresponding press portion 136B to rotate its corresponding rotation regulating member 132. This causes each rotation regulating member 132 that has been disposed at the deregulation position to move towards the regulation position. When each regulating portion 138A regulates the rotating shaft 50A of the driven roller 50, the driven roller 50 that has been disposed at the standby position is moved to the opposing position. In this state, the first transfer unit 18 is not capable of separating from the apparatus body 10A (see FIG. 14).

As shown in FIG. 5B, as the maintenance door 86 moves towards the covered position, the end portion of the pressing protrusion 124 comes into contact with the interlock switch 122, so that the interlock switch 122 is switched on. This allows the image forming apparatus 10 to form an image forming operation (interlocking is canceled). The body gear and the door gear (not shown) engage each other, so that rotational force is transmitted from the body to the transport rollers 76 (not shown) of the duplex transporting device 70.

When an attempt is made to move the maintenance door 86 towards the covered position without mounting the second transfer roller 22 on the moving member 106, the moving member 106 does not move relative to the maintenance door 86. Therefore, as shown in FIG. 1, each engaging portion 116 contacts its corresponding protruding portion 118B. This inhibits the movement of the maintenance door 86 towards the covered position, so that each engaging portion 116 and its corresponding engage portion 118 do not engage each other.

Since the movement of the maintenance door 86 towards the covered position is inhibited, as shown in FIG. 5A, the interlock switch 122 and the end portion of the pressing protrusion 124 do not contact each other. Therefore, the interlock switch 122 is not switched on. This prohibits the image forming apparatus 10 from performing an image forming operation (interlocking is performed).

As described above, when the second transfer roller 22 is not mounted on the moving member 106, the engaging portions 116 and the engage portions 118 do not engage each other, so that the holding of the maintenance door 86 at the covered position is suppressed.

When the second transfer roller 22 is not mounted on the moving member 106, each engaging portion 116 contacts its corresponding protruding portion 118B. This inhibits the movement of the maintenance door 86 towards the covered position.

When the maintenance door 86 does not move towards the covered position, the interlock switch 122 is not switched on. This prohibits the image forming apparatus 10 from performing an image forming operation (interlocking is performed). That is, erroneous operations in which a sheet material is not capable of being transported are suppressed.

Each engaging portion 116 is formed so as to be integrated to the moving member 106. Therefore, compared to when engaging portions are separately provided, the engaging portions 116 each have a low-cost structure.

As the maintenance door 86 is moved towards the covered position, the operation devices 128 move the driven roller 50 to the opposing position. This reliably positions the driven roller 50 to the opposing position.

Although the present invention is described by describing a particular exemplary embodiment in detail, the present invention is not limited to the exemplary embodiment. It is obvious to those skilled in the art that various other embodiments are possible within the scope of the present invention. For example, although, in the exemplary embodiment, the standards of the application are applied to the second transfer roller 22, they may also be applied to, for example, the transport rollers that transport a sheet material P.

What is claimed is:

1. An image forming apparatus comprising:

a covering/not-covering member that is supported by an apparatus body so as to be movable between a not-covered position where an opening is not covered by the covering/not-covering member and a covered position where the opening is covered by the covering/not-covering member, the opening being formed in the apparatus body where an image forming operation is performed in an interior of the apparatus body;

a transporting member that is mountable on and removable from the covering/not-covering member, the transporting member being movable relative to the covering/not-covering member while the transporting member is mounted on the covering/not-covering member, the transporting member being rotatable to transport a recording medium on which an image is formed while the transporting member is mounted on the covering/not-covering member and the covering/not-covering member is disposed at the covered position;

a positioning member that is provided at the apparatus body, the positioning member being configured to come into contact with the transporting member as the covering/not-covering member disposed at the not-covered position is moved to the covered position, and being configured to move the transporting member, which is disposed at a position that differs from a position where the recording medium is transportable, relative to the covering/not-covering member to position the transporting member to the position where the recording medium is transportable;

an engaging member that is provided at the covering/not-covering member, the engaging member being moveable as the transporting member is moved relative to the covering/not-covering member by the positioning member, and the engaging member being configured to engage an engage member and hold the covering/not-covering member at the covered position, the engage member being provided at the apparatus body; and an inhibiting member configured to come into contact with the engaging member and prevent the movement of the covering/not-covering member to the covered position.

2. The image forming apparatus according to claim 1, wherein the inhibiting member is configured to prevent the movement of the covering/not-covering member to the covered position when, in moving the covering/not-covering member from the not-covered position to the covered position, the engaging member is not moved relative to the covering/not-covering member by the positioning member.

3. The image forming apparatus according to claim 2, further comprising an allowing/prohibiting member that allows the image forming operation to be performed when the covering/not-covering member is disposed at the covered position, and that prohibits the image forming operation from being performed when the covering/not-covering member is not disposed at the covered position.

4. The image forming apparatus according to claim 3, wherein the covering/not-covering member is provided with a moving member, the moving member removably supporting the transporting member, the moving member moving the transporting member relative to the covering/not-covering member by moving relative to the covering/not-covering member, and wherein the engaging member is integrated with the moving member.

5. The image forming apparatus according to claim 4, further comprising an opposing transporting member and another positioning member, wherein the opposing transporting member is provided in the interior of the apparatus body, wherein, while the covering/not-covering member is disposed at the covered position, the opposing transporting member is disposed at an opposing position and rotates with the recording medium being interposed between the transporting member and the opposing transporting member, to transport the recording medium, the opposing position being where the opposing transporting member opposes the transporting member, and wherein, as the covering/not-covering member disposed at the not-covered position moves towards the covered position, the another positioning member comes into contact with the opposing transporting member disposed at a position differing from the opposing position, and moves the opposing transporting member to the opposing position to position the opposing transporting member.

6. The image forming apparatus according to claim 3, further comprising an opposing transporting member and another positioning member, wherein the opposing transporting member is provided in the interior of the apparatus body, wherein, while the covering/not-covering member is disposed at the covered position, the opposing transporting member is disposed at an opposing position and rotates with the recording medium being interposed between the transporting member and the opposing transporting member, to transport the recording medium, the opposing position being where the opposing transporting member opposes the transporting member, and wherein, as the covering/not-covering member disposed at the not-covered position moves towards the covered position, the another positioning member comes into contact with the opposing transporting member disposed at a position differing from the opposing position, and moves the opposing transporting member to the opposing position to position the opposing transporting member.

7. The image forming apparatus according to claim 2, wherein the covering/not-covering member is provided with a moving member, the moving member removably supporting the transporting member, the moving member moving the transporting member relative to the covering/not-covering member by moving relative to the covering/not-covering member, and wherein the engaging member is integrated with the moving member.

8. The image forming apparatus according to claim 7, further comprising an opposing transporting member and another positioning member, wherein the opposing transporting member is provided in the interior of the apparatus body, wherein, while the covering/not-covering member is disposed at the covered position, the opposing transporting member is disposed at an opposing position and rotates with the recording medium being interposed between the transporting member and the opposing transporting member, to transport the recording medium, the opposing position being where the opposing transporting member opposes the transporting member, and wherein, as the covering/not-covering member disposed at the not-covered position moves towards the covered position, the another positioning member comes into contact with the opposing transporting member disposed at a position differing from the opposing position, and moves the opposing transporting member to the opposing position to position the opposing transporting member.

9. The image forming apparatus according to claim 2, further comprising an opposing transporting member and another positioning member, wherein the opposing transporting member is provided in the interior of the apparatus body, wherein, while the covering/not-covering member is disposed at the covered position, the opposing transporting member is disposed at an opposing position and rotates with the recording medium being interposed between the transporting member and the opposing transporting member, to transport the recording medium, the opposing position being where the opposing transporting member opposes the transporting member, and wherein, as the covering/not-covering member disposed at the not-covered position moves towards the covered position, the another positioning member comes into contact with the opposing transporting member disposed at a position differing from the opposing position, and moves the opposing transporting member to the opposing position to position the opposing transporting member.

10. The image forming apparatus according to claim 1, wherein the covering/not-covering member is provided with a moving member, the moving member removably supporting the transporting member, the moving member moving the transporting member relative to the covering/not-covering member by moving relative to the covering/not-covering member, and wherein the engaging member is integrated with the moving member.

11. The image forming apparatus according to claim 10, further comprising an opposing transporting member and another positioning member, wherein the opposing transporting member is provided in the interior of the apparatus body, wherein, while the covering/not-covering member is disposed at the covered position, the opposing transporting member is disposed at an opposing position and rotates with the recording medium being interposed between the transporting member and the opposing transporting member, to transport the recording medium, the opposing position being where the opposing transporting member opposes the transporting member, and wherein, as the covering/not-covering member disposed at the not-covered position moves towards the covered position, the another positioning member comes into contact with the opposing transporting member disposed at a position differing from the opposing position, and moves the opposing transporting member to the opposing position to position the opposing transporting member.

12. The image forming apparatus according to claim 1, further comprising an opposing transporting member and another positioning member, wherein the opposing transporting member is provided in the interior of the apparatus body, wherein, while the covering/not-covering member is disposed at the covered position, the opposing transporting member is disposed at an opposing position and rotates with the recording medium being interposed between the transporting member and the opposing transporting member, to transport the recording medium, the opposing position being where the opposing transporting member opposes the transporting member, and wherein, as the covering/not-covering member disposed at the not-covered position moves towards the covered position, the another positioning member comes into contact with the opposing transporting member disposed at a position differing from the opposing position, and moves the opposing transporting member to the opposing position to position the opposing transporting member.

13. The image forming apparatus according to claim 1, wherein the image forming apparatus is configured such that, when the transporting member is not mounted on the covering/not-covering member, the covering/not-covering member is prevented from fully moving to the covered position.

14. The image forming apparatus according to claim 1, wherein the image forming apparatus is configured such that, when the transporting member is not mounted on the covering/not-covering member, the engaging member is prevented from engaging with the engage member.

15. An image forming apparatus comprising:

a covering/not-covering member that is supported by an apparatus body so as to be movable between a not-covered position where an opening is not covered by the covering/not-covering member and a covered position where the opening is covered by the covering/not-covering member, the opening being formed in the apparatus body where an image forming operation is performed in an interior of the apparatus body;

a transporting member that is mountable on and removable from the covering/not-covering member, the transporting member being movable relative to the covering/not-covering member while the transporting member is mounted on the covering/not-covering member, the transporting member rotating to transport a recording medium on which an image is formed while the transporting member is mounted on the covering/not-covering member and the covering/not-covering member is disposed at the covered position;

a positioning member that is provided at the apparatus body, the positioning member coming into contact with the transporting member as the covering/not-covering member disposed at the not-covered position is moved to the covered position, and moving the transporting member, which is disposed at a position that differs from a position where the recording medium is transportable, relative to the covering/not-covering member to position the transporting member to the position where the recording medium is transportable;

an engaging member that is provided at the covering/not-covering member, the engaging member moving as the transporting member is moved relative to the covering/not-covering member by the positioning member, to engage an engage member and hold the covering/not-covering member at the covered position, the engage member being provided at the apparatus body, and an opposing transporting member and another positioning member, wherein the opposing transporting member is provided in the interior of the apparatus body, wherein, while the covering/not-covering member is disposed at the covered position, the opposing transporting member is disposed at an opposing position and rotates with the recording medium being interposed between the transporting member and the opposing transporting member, to transport the recording medium, the opposing position being where the opposing transporting member opposes the transporting member, and wherein, as the covering/not-covering member disposed at the not-covered position moves towards the covered position, the another positioning member comes into contact with the opposing transporting member disposed at a position differing from the opposing position, and moves the opposing transporting member to the opposing position to position the opposing transporting member.

* * * * *